United States Patent [19]

Laditka

[11] Patent Number: 4,477,203

[45] Date of Patent: Oct. 16, 1984

[54] APPARATUS AND METHOD FOR APPLYING COATINGS TO TRAFFIC SURFACES

[76] Inventor: Alexander Laditka, 4741 Dalebridge Rd. #C-10, Warrensville Hts., Ohio 44128

[21] Appl. No.: 408,484

[22] Filed: Aug. 16, 1982

[51] Int. Cl.[3] ..... E01C 19/20; E01C 19/21

[52] U.S. Cl. ..... 404/111; 404/112; 404/113; 366/345

[58] Field of Search ..... 404/75, 76, 108–113; 366/345, 346; 222/529, 545; 280/263; 188/16; 299/41; 251/8, 121

[56] References Cited

U.S. PATENT DOCUMENTS

| | | | |
|---|---|---|---|
| 782,459 | 2/1905 | Morris | 222/368 |
| 1,437,863 | 12/1922 | Raymond | 222/317 |
| 1,914,950 | 6/1933 | Kanen | 404/111 |
| 2,241,214 | 5/1941 | Milster | 188/16 |
| 2,668,976 | 2/1954 | Beach | 15/230 |
| 2,717,725 | 9/1955 | Bennett | 222/485 |
| 2,725,945 | 12/1955 | Beaudoux et al. | 188/16 |
| 2,754,733 | 7/1956 | Beyer | 404/112 |
| 2,796,203 | 6/1957 | Masters et al. | 222/311 |
| 2,799,037 | 7/1957 | Grogan | 15/172 |
| 2,835,420 | 5/1958 | Foley | 222/485 |
| 3,183,803 | 5/1965 | Gierhart | 94/44 |
| 3,187,845 | 6/1965 | Ashley et al. | 188/16 |
| 3,279,337 | 10/1966 | Weaver | 94/44 |
| 3,283,675 | 11/1966 | Gifford et al. | 94/39 |
| 3,305,887 | 2/1967 | Turner | 15/50 |
| 3,333,518 | 8/1967 | Sholl et al. | 94/44 |
| 3,452,381 | 7/1969 | Bratti | 15/98 |
| 3,458,885 | 8/1969 | Danielsson | 15/50 |
| 3,515,041 | 6/1970 | Murtaugh | 94/44 |
| 3,533,336 | 10/1970 | Wikel | 94/44 |
| 3,559,543 | 2/1971 | Schwoebel, Jr. | 94/44 |
| 3,580,638 | 5/1971 | Pulles | 299/41 |
| 3,703,856 | 11/1972 | Wikel et al. | 94/44 |
| 3,776,430 | 12/1973 | Grandrud | 222/177 |
| 3,791,754 | 2/1974 | Zochil | 404/112 |
| 3,841,779 | 10/1974 | Ray | 404/111 |
| 3,989,403 | 11/1976 | Verive | 404/111 |
| 4,096,879 | 6/1978 | Serur et al. | 251/121 |
| 4,172,580 | 10/1979 | Raftis | 251/8 |
| 4,302,128 | 11/1981 | Thatcher | 404/111 |

OTHER PUBLICATIONS

Seal Master Blacktop Sealing Machine brochure and three accompanying photographs, Wikel Mfg. Corp.

Huber SC-150 Sealcoat Applicator brochure, Huber Co.

Nu-Surf Seal Applicator brochure, Gierhart Machinery Co.

Asphalt Sealing Machine brochure, Allied Steel & Tractor Products, Inc.

The New Surf-Seal for Asphalt Sealcoating brochure, Specialized Equipment of Wakeman.

Seal-Master Applicator brochure, Wikel Mfg. Co.

Now the Erie Applicator brochure, Erie Applicator, Inc.

(List continued on next page.)

*Primary Examiner*—Ernest R. Purser

*Assistant Examiner*—Mark J. DelSignore

*Attorney, Agent, or Firm*—David A. Burge

[57] ABSTRACT

A method and apparatus for coating traffic surfaces is disclosed in which, in lieu of preparing a batch of coating material, the coating ingredients are independently deposited on the traffic surface and a rotary tool with depending blades is brought into contact with the surface to be coated to effectively mix the ingredients while upon the surface so as to rapidly produce, distribute and apply a uniform composition. The apparatus aspect is represented by a machine in which there are various tanks and hoppers for the individual ingredients, with operator accessible controls for starting, stopping and metering such deposits. In addition the machine carries means for rotatably driving the tool, and for raising and lowering the tool to control the nature of blade contact with the surface being coated. The machine is provided with swivellable wheels that can be braked, whereby it is possible to readily maneuver the machine and effect coating application within small areas and within areas having irregular boundaries.

20 Claims, 8 Drawing Figures

OTHER PUBLICATIONS

Now The Seal-Rite Applicator brochure, Seal-Rite Applicator, Inc.

An untitled brochure published by Erie-Go Manufacturing Co.

Applicator for Emulsified Asphalt & Tar Seal Coat Materials, Pavers Mfg. Co.

Specialized Sealcoating Equipment for Quality Jobs, Contract Asphalt Maintenance Co.

Seal-Master, Asphalt Maintenance Equipment by Wikel.

Seal-Mor, Neal Mfg. Co., Inc.

Fig. 4
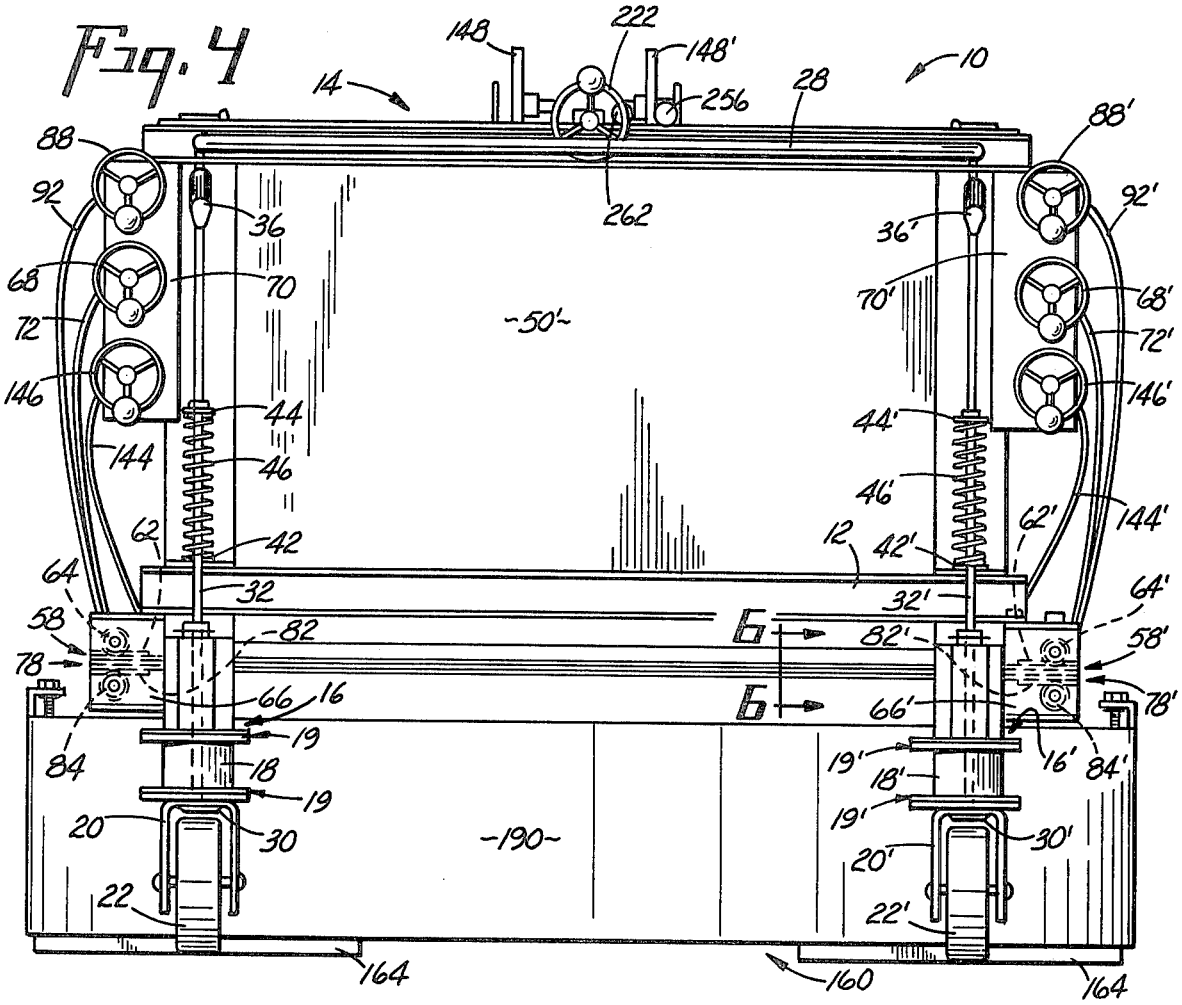
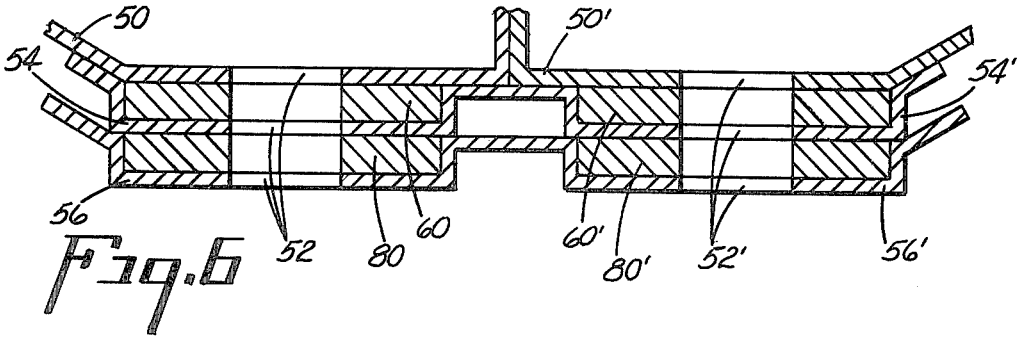
Fig. 6

Fig. 5
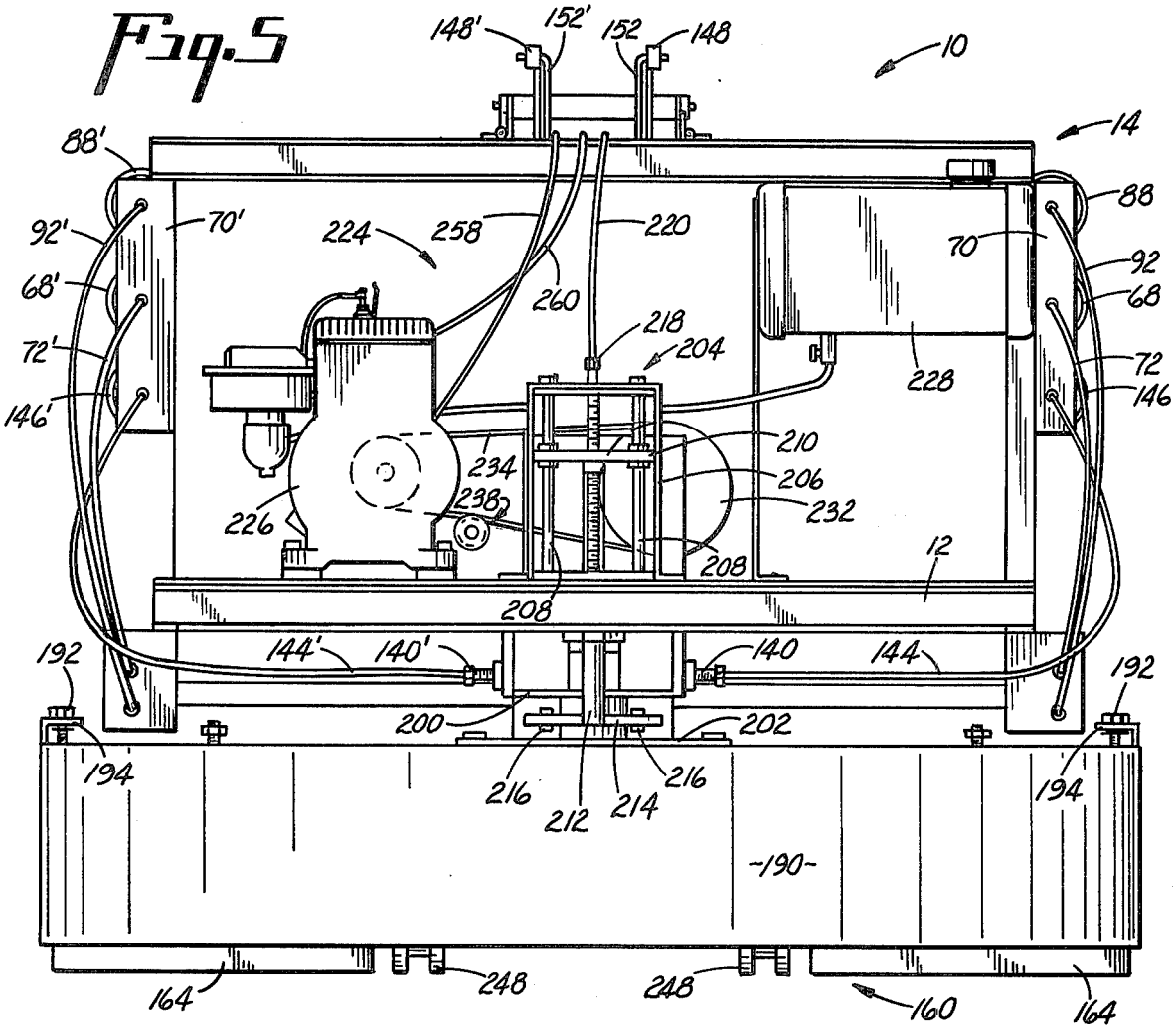
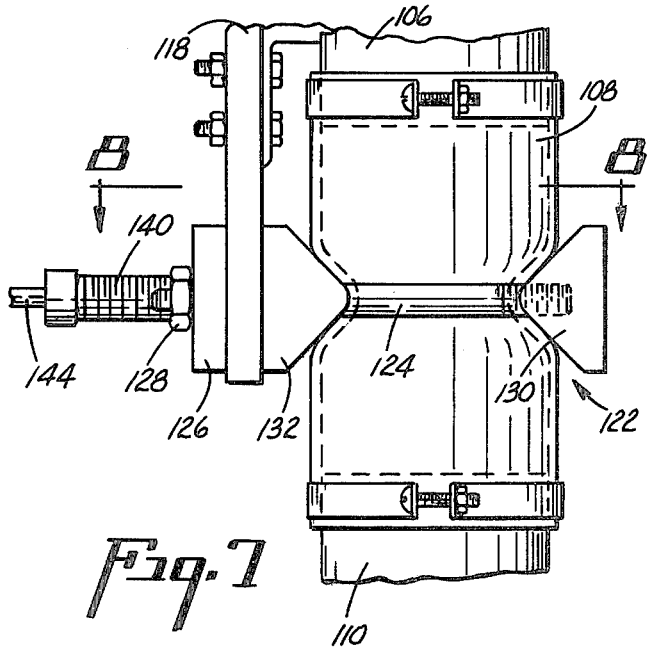
Fig. 7
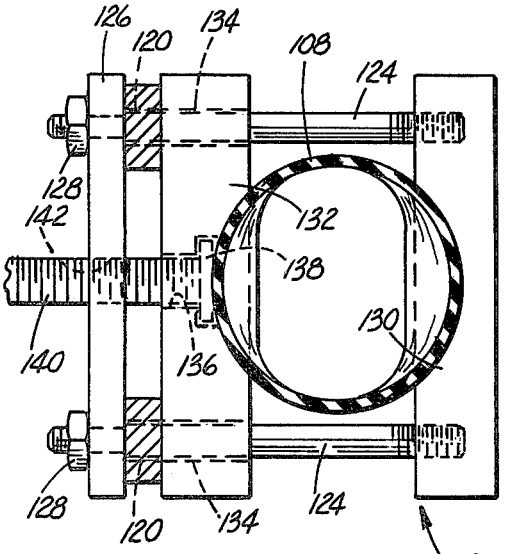
Fig. 8

APPARATUS AND METHOD FOR APPLYING COATINGS TO TRAFFIC SURFACES

BACKGROUND OF THE INVENTION

1. Field of the Invention

The present invention relates generally to the coating of relatively large generally horizontal surfaces such as roads, driveways, parking lots, tennis courts, flat roofs, rain water catchments and similar surfaces of which embrace sufficient areas to warrant the use of a machine to effect coating application. For convenience these surfaces are herein referred to as "traffic surfaces", it being understood that this term is not used in any restrictive sense and is not confined, for example, to surfaces which accommodate vehicular traffic.

2. Prior Art

Traffic surfaces are exposed to wear and often to the effects of the elements with the result that they ae subject to deterioration. They accordingly require protective coatings to extend their useful lives. These coatings may be applied at the time the surface is constructed, but are more frequently required after a certain amount of use in order to restore the surface to a desirable condition and to overcome the effect that spalling, minor cracks and the like may have had in accelerating surface deterioration.

In some cases these coatings can be applied manually with long handled applicators; however, if the area to be treated is sufficiently large, it is preferably treated by mobile equipment such as machines which have a tank for the liquid or slurry type of coating material, dispensing apparatus for metering the coating material onto the surface to be treated, and mechanism for spreading the applied coating in a thin layer upon the surface. In some cases, it is advisable to apply particulate material such as sand to the surface to improve its frictional properties, and this has been done by separately applying the sand through its own dispensing mechanism upon the already coated surface where it partakes somewhat of the spreading action of the devices such as elongate squeegees and/or paddle wheel assemblies which are used to smooth and level the liquid coating material.

Machines of the type described in the preceding paragraph have significant limitations. For one thing they are essentially single purpose machines in that they can apply to the surface being treated only the one material with which the tank has been charged, except that sand can be either added or withheld at the operator's option. Such machines are not equipped to substantially vary the composition of the coating during application, nor are they capable of applying coating materials, such as epoxy coatings, whose ingredients, once combined, set up by chemical action and have a rather short period after being mixed during which they can be successfully stored and dispensed. These machines are likewise incapable of handling coating materials which involve problems such as a tendency of the liquids and or solids to separate rapidly so that uniform consistency of a batch in the supply tank is short-lived.

Another respect in which the prior art machines are limited is that they are essentially large area machines intended mainly for travelling along highways in a basically unidirectional fashion, and are incapable of working in constricted or unusually shaped areas. Moreover the spreading and leveling devices with which these machines are equipped are capable of treating only surfaces which have a high degree of flatness lateral to the primary direction of machine travel. Moreover, such machines cannot execute immediate reversals in direction to correct or supplement the coating being applied.

SUMMARY OF THE INVENTION

The present invention overcomes the drawbacks of the prior art by providing equipment which has the capacity to store plural liquid materials and plural solid particulate materials individually so that their interaction upon mixing, if it would prove detrimental to storage and dispensing, will offer no problem.

Equipment embodying features of the present invention has the capability of selectively depositing selected liquid and/or solid ingredients independently and in close proximity to each other upon the surface to be coated, and to thoroughly mix the deposited ingredients in situ upon the surface while smoothing or trowelling the coating to effect its application and achieve the desired surface texture. The equipment is capable of applying materials uniformly to an existing surface, or of applying materials non-uniformly in thickness as may be needed to effect surface leveling or smoothing.

The equipment of the invention includes features which permit the operator to closely control the rate of delivery of any of the individual materials to the surface where they are being mixed, as well as to interrupt delivery of any material temporarily without altering the rate of delivery setting, and without disturbing the delivery of the other materials being used at the time.

The equipment of the invention is so constructed as to permit its use not only on large and longitudinally extended surface such as roads and large driveways, but to facilitate coating surfaces which are small and irregular in shape, and which exhibit areas with significantly varying treatment requirements. It also embodies features which will accommodate and adequately treat surfaces whose vertically measured irregularities are significantly more severe than those treatable by equipment of the prior art.

Furthermore, the equipment of the invention exhibits features of adjustability and flexibility which allow the mechanical application of the coating mixture to accommodate a wide variety of conditions arising from the nature of the coating composition being applied and/or from the nature of the receiving surface. In preferred practice, equipment embodying the present invention enables the pressure with which coatings are mixed, distributed and applied to be adjusted, as well as the speed, direction of rotation, and orientation applicator elements. Moreover, the machine is highly versatile in its preferred form, permitting control of the composition of the material being applied as well as the rate at which it is dispensed. Furthermore, these controls can be exercised without interrupting operation of the machine.

BRIEF DESCRIPTION OF THE DRAWINGS

The foregoing and other features of the present invention will be better understood by referring to the description of the preferred embodiment and claims which follow, taken together with the accompanying drawings, wherein:

FIG. 3 is a sectional view as seen from a plane indicated by a line 3—3 in FIG. 1;

FIG. 5 is an end elevational view of the machine as viewed from the left in FIG. 1;

FIG. 6 is a detailed sectional view as seen substantially from a plane indicated by a line 6—6 in FIG. 4;

FIG. 7 is a detail elevational view of a metering mechanism for controlling flow from a liquid ingredient tank; and FIG. 8 is a detail sectional view as seen substantially from a plane indicated by a line 8—8 in FIG. 7.

DESCRIPTION OF THE PREFERRED EMBODIMENT

Figure 1:
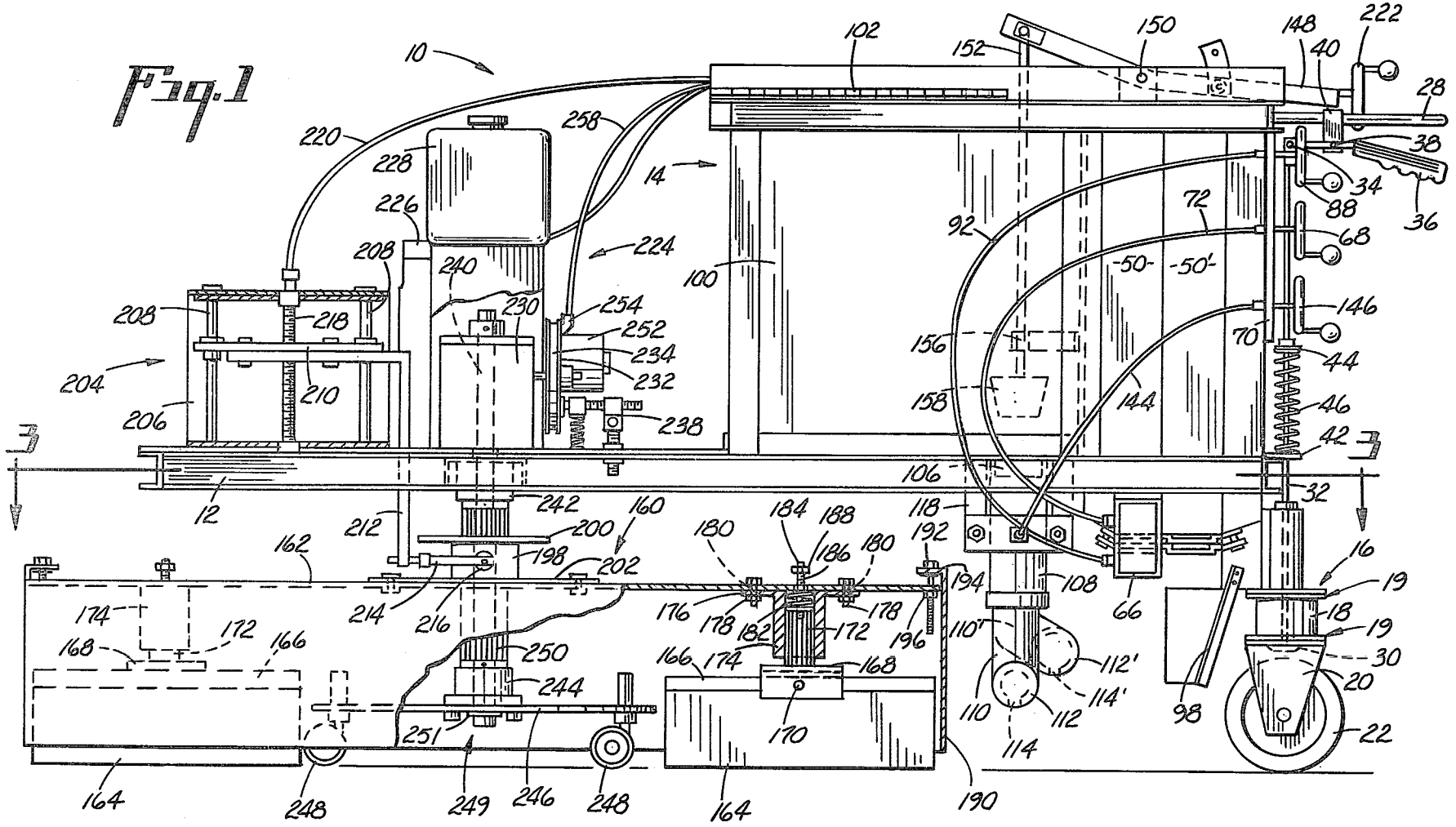
FIG. 1 is a side elevational view of a machine embodying the preferred practice of the present invention with parts broken away and parts omitted for clarity.

Referring to the accompanying drawing and especially to FIG. 1 thereof, a machine embodying the preferred practice of the present invention is indicated generally by the numeral 10. The machine includes a primarily horizontal frame 12, at one end of which is a superstructure 14 and depending wheel support structures 16, 16′ which includes elastomeric shock-absorbing bushing 18, 18′ having disc-type bearings 19, 19′ at their upper and lower ends, and swivelling forks 20, 20′ which rotatably mount a support wheel 22, 22′.

As will be seen, the wheels 22, 22′ support one end of the frame 12 upon the surface to be coated. The other end of the frame is supported by a combined tool driving and support mechanism which will be described in detail hereinafter.

The machine being presently described is intended to move about upon the traffic surface by means of the support wheels 22, 22′ to effect its coating function, and this movement is brought about manually by means of a U-shaped handle bar 28 which extends athwart the machine at the end including the superstructure 24.

BRAKING MEANS FOR MACHINE PATH CONTROL

For a purpose which will hereafter appear, an individual braking mechanism is associated with each of the wheels 22, 22′. In the case of wheel 22 this braking mechanism includes a brake pad 30 connected to the bottom of the end of a relatively rigid thrust rod or cable 21 whose upper end is connected at 34 with one end of an actuating lever 36 which is pivotally connected at 38 to a bracket 40 clamped to one of the legs of the U-shaped handle 28. The pivotal mounting 38 is midway of the lever so that the operator, by drawing the end of the lever upwardly towards the handle 28 causes the rod 32 to be forced downwardly, applying the brake pad 30 to the wheel 22. The brake pad 30 preferably has a rotary connection with the rod 32 which readily allows the wheel 22 and frame 12 to undergo a relatively swiveling movement while the brake is applied. A spring perch 42 mounted on the frame 12 has a guiding opening through which the rod 32 passes, and the rod has a stop member 44 suitably clamped thereto. Between the perch 42 and the stop 44 is a compression spring 46 which serves to release the brake whenever the operator removes hand pressure from the brake actuating lever 36.

The wheel 22′ has a braking mechanism identical to that described for wheel 22, and, for simplicity, the parts have the same numeral designations as for the wheel 22 brake mechanism except that the numerals are primed.

STORING AND DISPENSING OF INDIVIDUAL INGREDIENTS

Mounted upon the upper surface of the frame 12 at the end adjacent the wheel 22, 22′ and forming a part of the superstructure 14 are a number of containers for holding supplies of individual coating ingredients. These are best seen in FIG. 1 where they are designated by the numerals 50 and 50′ which indicate hoppers for particulate material such as sand, glass beads, particles of ground rubber, short staple lengths of fibers such as glass or asbestos, or any of many other such materials used in the compounding of compositions for coating traffic surfaces. The hoppers 50, 50′ extend from side to side of the frame 12. The following description will discuss the hopper 50 and its associated mechanisms in detail.

The hopper 50 in its lower portion has a trough with a flat bottom in which is provided a row of uniform and uniformly spaced dispensing ports extending from side to side of the machine. One of these ports can be seen in section as designated by the numeral 52 in FIG. 6. As can also be seen in FIG. 6, each port 52 is actually a series of stacked aligned openings. The uppermost opening of the port is formed in the bottom plate of the hopper 50, and the other two are in guide tracks 54, 56 which underlie and are affixed to the bottom of the hopper 50 for a purpose which will presently appear.

Figure 4:
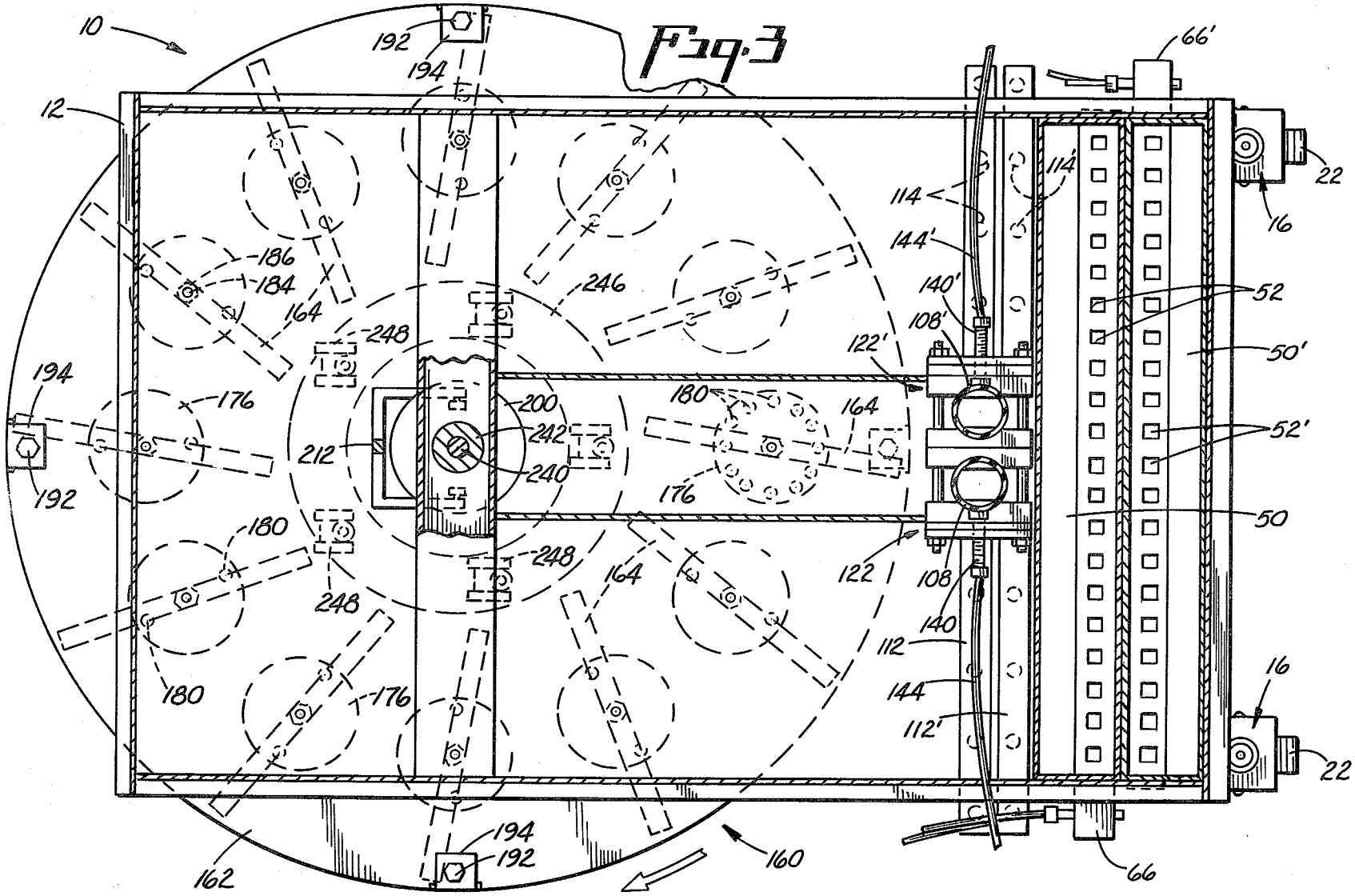
FIG. 4 is an end elevational view of the machine as viewed from the right in FIG. 1, with parts being omitted for clarity.

A valve mechanism, generally indicated at 58 in FIG. 4, comprises a slide 60 (FIG. 6) which is carried by the track 54, and which has openings matching the ports 52. The slide 60 can be shifted between open and closed positions to start and stop the flow of material from ports 52 is desired. Referring to FIG. 4, movement of the slide is effected by means of a short rack 62 on the slide which meshes with a pinion 64 rotatable in a housing 66 at one side of the machine. Rotation of the pinion is manually controlled by a handwheel 68 mounted on a control panel 70 at one side of the machine near the operator's handle 28. A rotary drive cable 72 (FIG. 1) is connected at one end to the shaft of the hand wheel 68, and at its other end of the shaft of the pinion 64. Thus, by rotating the hand wheel 68 in one direction or the other, the operator can open or close the ports 52 associated with the hopper 50 at will.

The means for controlling the dispensing of particulate material from the hopper 50 also includes a metering control, generally indicated at 78 in FIG. 4 which can be set to restrict the effective size of the ports 52 to any desired degree. The mechanism is generally similar to the valving mechanism just described, and includes a slide 80 carried in the track 56, a rack 82, a pinion 84 mounted in the housing 66, and is operated by a handwheel 88 on the control panel 70 which is connected to the pinion 84 by a rotary drive cable 92. Thus the operator can determine a desired setting to give the proper proportions to the resulting mix, which setting will not be disturbed by any necessity for temporarily discontinuing the flow of material from hopper 50 by means of the valve mechanism 58.

The other hopper 50′ is essentially like the hopper 50 and the dispensing controls are essentially the same and are indicated by the same reference numerals as those used in connection with the hopper 50, but primed. It will be understood, of course, that the housing 66′, a control panel 70′ and the associated elements are mounted on the opposite side of the machine from the corresponding elements relating to the hopper 50.

The cables 92, 92' are provided with digital indicators (not shown) to provide a clear indication of the sizes of the dispensing port openings.

As can be seen from FIG. 1 there is preferably provided a shield plate 98 attached at its ends to depending frame elements of the superstructure 14 and extending from one side to the other of the machine 10. This shield will avoid the possibility of any interference with the wheels 22 and 26 or their brake mechanisms by the particulate material being dispensed from the hoppers 50 and 50'. The shield is omitted in FIG. 4 to avoid unnecessarily complicating the view.

Mounted on the frame 12 adjacent the hopper 50 are side-by-side tanks 100, 100' for holding supplies of liquid coating ingredients. The tank 100 and the dispensing mechanisms associated therewith will be described in detail. The upper end of the tank 100 is closed by a hinged cover 102 operated by a handle 104. At one corner of the tank bottom which is near the center line of the machine 10 and preferably the lowest point in the bottom there is formed a discharge port surrounded and defined by a depending nipple 106, FIGS. 1 and 7. The upper end of a flexible resilient conduit 108 is clamped to the nipple 106, and its lower end is clamped to the upstanding neck 110 of a tubular dispensing manifold 112 which extends horizontally in opposite directions from the neck 110 to each side of the machine 10. The manifold 112 has a row of downwardly opening ports 114, from which the liquid in tank 100 can be dispensed upon the traffic surface. The distal ends of the manifold are preferably supported from the frame 12 by suitable support hangers (not shown).

In order to meter the flow of liquid from the tank 100, there is provided a means for pinching or constricting the resilient conduit 108 shown in detail in FIGS. 7 and 8. Support hangers 118 are affixed to and depend from the frame 12 and are drilled at 120, 120 (FIG. 8) to accept guide rods 124, 124 with a free sliding fit. A floating clamp assembly 122 is mounted in the openings 120, 120 and supported by the hangers 118, 118. The clamp assembly includes the above-mentioned guide rods 124, 124 which are each shouldered and threaded at one end. A base bar 126 has openings at each end which receive the reduced ends of the guide bars 124 and are clamped against the shoulders of the guide bars by nuts 128, 128. The other ends of the guide bars 124 are fixedly associated with a pinch member 130 as by a threaded connection; thus forming a rigid frame consisting of the members 124, 124, 126, 128, 128 and 130. Slidable on this frame is another pinch bar 132 which has openings 134, 134 loosely receiving the rods 124, 124 and a central slot 136 for trappingly and rotatably accepting the enlarged end 138 of a drive screw 140. The drive screw 140 is threadedly mounted in a central threaded bore 142 of the base bar 126, so that rotation of the drive screw 140 in one direction or the other causes the pinch members 130 and 132 to be moved towards or away from each other, thus controlling the cross sectional area of the passage through the resilient conduit 108.

A flexible rotary drive cable 144 connects the drive screw 140 with a handwheel 146 on the control panel 70.

In order to provide an instantaneous shut off for the flow of liquid from the tank 100, a control lever 148 is pivoted at 150 on a frame member at the top of the superstructure 14. The lever 148 is connected with a vertically reciprocable shaft 152 which is slidable through an opening in the top of the tank 100 and through a guide 156 mounted on an interior wall of the tank 100. The bottom end of the shaft is connected with a plug 158 which is positioned to seat in the discharge opening at the nipple 106. The operator, by manipulating the lever 148 can thus start and stop the liquid flow of the liquid material when required. The lever 148 is preferbly provided with suitable detent, (not shown) to assist in retaining it at its fully open and fully closed positions.

The other tank 100' is essentially like the tank 100 and the dispensing controls are essentially the same and are indicated, wherever visible, by the same reference numerals as those used in connection with the tank 100, but primed. With reference to the neck 110' of the manifold 112' it will be recognized that the neck is bent so as to offset the manifold 112' from the manifold 112 as seen in FIG. 1 in order to eliminate interference during deposit of the tank contents when the machine is operating.

The cables 144, 144' are provided with digital indicators (not shown) to provide the operator with a clear indication of the status of pinch valve closures.

As can be seen in FIGS. 1 and 3, ingredients are deposited in bands of material extending the width of the frame 12, and the blends are clustered in a relatively confined area so that, when mixed together by subsequent operations to be presently described, the resulting mixture will exhibit a high degree of uniformity in the proportions of the ingredients, except as variations are intentionally introduced by operator control.

MIXING OF THE INGREDIENTS TO FORM A COATING COMPOSITION, AND APPLYING TO THE COATING COMPOSITION A SURFACE FINISH

After the ingredients of the desired mixture have been deposited on the traffic surface to be coated, the trailing end of the machine passes over and provides a mixing and finishing tool which not only stirs and mixes the ingredients thoroughly, but also spreads and/or trowels the resulting coating in any of various selected ways under operator control to produce the desired surface finish appropriate to the nature of the traffic surface and its usage, and to the particular requirements of the coating composition.

The mixing and finishing tool is identified generally by the reference character 160, is perhaps best seen in FIGS. 1 and 3, and comprises a rotating disk 162. Depending from the disk around its periphery are a plurality of mixing and spreading members which may be of various types, but for most uses these preferably take the form of blades of flexible material such as natural or synthetic rubber, and are each indicated in the drawing by the reference character 164. It will be noted that the showing in FIG. 1 includes only two such blades 164 in order to avoid confusion, but there are preferably a significant number of such blades, for example 12, as seen in FIG. 3. Each blade 164 has a thicker spine 166 at its upper edge which is received and fastened in a yoke 168 which has the form of a channel. The blade 164 is pivotally mounted in the yoke 168 at 170 in such a manner as to allow some overhead clearance permitting the blade 164 to rock slightly about the pivot 170, allowing the blade 164 to accommodate itself to irregularities in the traffic surface. Also, the yoke is integral with a stem 172 which is received in a sleeve 174. The stem and sleeve meshing in a fashion preventing relative rotation, as by splining, for example. The sleeve 174 is integral with a plate 176 which is clamped to the disk 162 by bolts 178 associated with the plate 176 and passing through openings 180 in the disk. Within the sleeve 174 between the upper end of the stem 172 and the disk 162 is a compression spring 182 which acts to urge the blade 164 against the traffic surface and allows it to retract bodily and independently of the other blades if surface irregularities should make this necessary. A screw 184 projects from the upper end of the stem 172, passes freely through an opening 186 in the disk 162, and has a nut or other enlargement 188 acting as a stop to prevent escape of the stem 172 from the sleeve 174 whenever the disk 162 is lifted high enough to allow the blades 164 to clear the traffic surface.

Referring to FIG. 3, it will be noted that there is shown a pair of small circles that are associated with most of the plates 176. These represent somewhat diagramatically the location of the mounting holes 180 for the plate 176 on the disk 162 to provide the blade angles shown. In actuality a preferred form is represented by the plate 176 in the rightmost position in FIG. 3 wherein the disk 162 is provided with a larger number of holes 180, for each blade location which would allow each blade to be placed in any of many angular positions about its vertical axis. The drawing should be understood as having omitted the repetitive showing of these many openings for convenience and clarity, and that such an arrangement for each of the blades 164 is contemplated.

The mixing and finishing tool 160 also includes about its periphery and depending from the plate 162, a cylindrical shield 190 which helps to confine any splatter or spray resulting from the mixing operation, and provides a guard against accidental injury to persons from the rotating blades, or to the blades themselves from encounter with foreign bodies which might be accidentally brought into contact with them.

The shield is preferably mounted on the disk by adjusting support screws 192 which each has its head mounted in rotatably trapped relationship to an opening in a bent over ear 194 on the shield 190 and which is threaded into a corresponding tapped boss 196 integral with the disk 162. This permits the shield to be slightly adjusted to permit it to be positioned as closely to the traffic surface as possible, depending upon the elevation at which the tool is being operated, since the tool is capable of vertical adjustment as will presently appear.

Firmly attached to the top central surface of the disk 162 of the tool 160 is a hub 198 with an upper flange 200 and a lower flange 202. Cooperating with the flanges of the hub 198 is an elevator mechanism indicated generally at 204 which can be used by the operator to place the tool at the desired elevation for mixing and finishing under various circumstances of operation, or for raising the tool clear of the traffic surface when not operating.

The elevator mechanism 204 comprises a subframe 206 mounted on the upper surface of the frame 12. The subframe comprises four vertical guide shafts, each designated 208. Slidingly associated with the guide shafts is a platform 210 arranged for up and down movement. The platform 210 has an integral depending arm 212 which passes through an opening in the deck of the frame 12 and is rigidly connected with a horizontal fork 214, each arm of which has at its tip a roller 216. The fork arms and the rollers are so located that they enter between the flanges 200 and 202 whereby the rollers 216, 216 will encounter one flange or the other as they move up and down with the platform 210.

A vertical drive screw 218 is centrally mounted and is journaled near its opposite ends and prevented from moving axially by the subframe 206. The screw 218 is threadedly connected with the platform 210 for lowering and raising motion thereof as the drive screw 218 is rotated. The upper end of the drive screw 218 is connected with a flexible rotating drive cable 220 which, at its other end is connected with a hand wheel 222 located at the upper center of the machine near the operator's handle 28.

MEANS FOR DRIVING THE MIXING AND FINISHING TOOL AND FOR SUPPORTING THE FRAME

Figure 2:
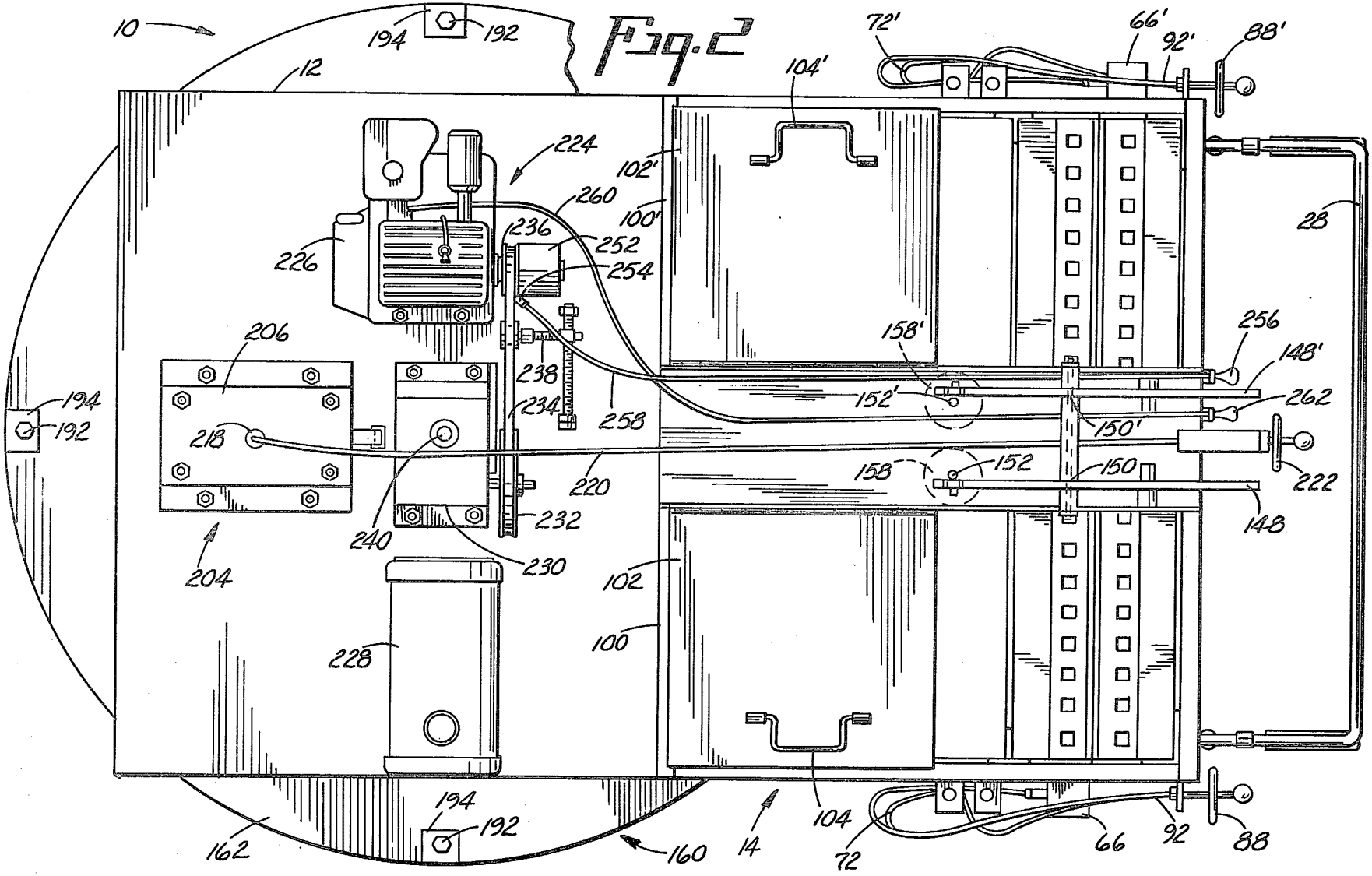
FIG. 2 is a top plan view of the machine of FIG. 1.

A power drive assembly 224 is mounted upon the upper surface of the frame 12 and includes a power source such as the internal combustion engine 226 and fuel tank 228, and speed reduction gearing 230 as seen in FIGS. 1, and 2. The gearing 230 is arranged on the longitudinal centerline of the frame 12 and has an input pulley 232 driven by a belt 234 from an output pulley 236 of the engine 226. A suitable adjustable belt tightener 238 is provided for accommodating slack which may develop as the belt 234 stretches with use.

The output shaft of the reduction gearing 230 is designated 240 and extends downwardly through the deck of the frame 12 where it passes through a combined sleeve and thrust bearing 242. The shaft continues downwardly to a point close to the traffic surface where it passes through another sleeve and thrust bearing 244 which is centered upon and integral with a circular spreader plate 246 supported on the traffic surface by a plurality of casters 248 (in this case five) to form a carriage 249. The casters 248 are preferably resiliently connected through elastomeric shock mounts (not shown) to the plate 246.

Between the two bearings 242 and 244 and surrounding the shaft 240 is a thrust sleeve 250 which transmits forces between the bearings 242, 244. The sleeve 250 receives from the upper thrust bearing 242 the load due to the weight of the machine, and transmits this load, via the lower thrust bearing 244 to the carriage 249 and thence to the traffic surface. While the carriage 249 and the lower end of the shaft 240 are normally held in assembled relationship by the weight of the machine, there is preferably a retainer such as snap ring 251 to retain the carriage on the slat in case the machine 10 is bodily raised for any reason.

The sleeve 250 is not only a thrust sleeve, but also a driving member for transmitting rotation to the tool 160. It is accordingly internally keyed to the shaft 240, and its exterior exhibits splines which mesh with corresponding splines on the interior of the hub 198. It is thus possible for the assembled shaft 240 and sleeve 250 to support the weight of the machine via the carriage 249 while at the same time acting as the rotary drive for the tool 160. This drive is also effective in various raised and lowered positions of the tool 160 due to the splined connection of the sleeve 250 and the hub 198, and the capability of the elevator mechanism 204 to control tool position during its rotation is made possible by the cooperation of the rollers on the fork 214 with the flanges 200 and 202 of the hub 198.

The elevator mechanism 204 can be used to set the level of the tool 160 in four distinct ranges. First, when the control wheel is turned to place the platform 210 in the uppermost position, it raises the tool 160 to a position where the blades are clear of the traffic surface to allow moving of the machine from place to place. Secondly, the platform 210 can be so adjusted that it supports most of the tool weight, but allows the blades 164 to wipe lightly over the coated surface. Thirdly, the platform can be lowered until the rollers 216 of the fork 214 are free of both flanges 200 and 202, as seen in FIG. 1, in which case the tool 160 rests with its own weight upon the blades 164 which strongly wipe the surface being coated as the tool 160 is rotated. Fourthly, if the platform 210 is lowered sufficiently, the weight of the left hand end (FIG. 1) of the machine can be progressively applied to the tool 206 through flange 202, causing the blades 164 to deflect and produce a trowelling effect of desired force which is limited, of course, by the maximum effect of the machine weight just as the casters 248 of carriage 249 are about to lose contact with the traffic surface.

With regard to the controls on tool rotation, it will be noted that the power can be connected or disconnected from the tool 160 to start or stop its rotation by a clutch 252 at the output shaft of the engine. A clutch control lever 254 is connected by a bowden wire 258 with a control knob 256 adjacent the operator's handle 28. The speed with which the tool 160 is rotated is controlled by the throttle of engine 226 which is connected by a bowden wire 260 with a throttle control knob 262 adjacent the operator's handle 28.

OPERATION

The operator first assesses the traffic surface to be treated, and then charges the hoppers 50, 50' and tanks 102, 102' with the separate ingredients needed to make up the coating composition of the general type which will be required for the job at hand, or at least for the particular coating problem immediately presented in case the nature of the condition indicates that plural superimposed coating treatments of significantly varying types will be needed. All ingredients in the containers may not be required for the general coating procedure, but certain ones will perhaps be included for use intermittently to treat special local problems of the surface whenever encountered.

With the hopper on-off valve mechanisms 58, 58' and the on-off plugs 158 and 158' of the tanks 100 and 100' set in "off" or non-flow positions, the operator adjusts the hopper metering controls 78, 78' by means of handwheels 88, 88' and the floating clamp metering controls 122, 122' of the tanks by means of handwheels 146, 146' to permit the proper flow under operating conditions such that the proportions of the resulting mixture, when formed on the traffic surface, will be correct. These settings will normally have been previously determined by calculation confirmed by test runs, and provided in tables for the operator's guidance.

Assuming merely a relatively straight elongate surface to be coated, the operator would start the engine 226 and pull the machine 10 into initial position by the handle 28. He would then open such of the valves 58, 58' by means of handwheels 68, 68', and such of the plugs 158, 158' by means of levers 148, 148' as control the containers whose ingredients will be needed for the ingredients of the basic coating about to be applied. At the same time he will operate the handwheel 222 to present the blades 164 of the tool 160 to the traffic surface with the degree of contact indicated for the type of treatment and consistency of coating being provided.

As he starts to move the machine 10 by its handle 28 in a direction to the right as seen in FIG. 1, the operator engages the clutch 252 by means of the control knob 256 to start rotation of the tool 160, and adjusts the speed of rotation by the throttle control knob to give the prescribed speed of tool rotation for the job at hand, usually in the vicinity of 45 to 80 RPM.

Just after the various containers deposit portions of their contents on the traffic surface in correct proportions for the final mix, the tool 160 passes progressively over these deposits and thoroughly mixes the ingredients to form the desired coating material. Several features of the mechanism contribute to this mixing action. First the large number of blades and their relatively rapid movement contribute to efficient stirring. Secondly it will be noted that the direction of movement of the ingredients is periodically altered by the design of the tool. The blades 164 are normally set at a slight angle to the radius of the tool so that coating material has a slight vector in a rearward direction as the lead blades sweep over it, and in a forward direction as the trailing blades encounter it. In addition, for situations calling for more active stirring, the blades may be set in different angular positions prior to the run by releasing the fasteners 178, turning the plates 176 through the desired angle and then attach them to the disk 162 using a different set of mounting openings 180, 180. Frequently the blades are so set that they make alternate positive and negative angles with their radii so that the direction of movement of the mix along the blade edge will be very rapidly alternated as the blades pass a particular spot.

In some instances the ingredients are of a character such that even more intensive mixing is required. In such a case the machine 10 may be caused to traverse a short length of traffic surface with the dispensing orifices open, then the shut-off devices (e.g. valves 58 and 58' and plugs 158 and 158') can be operated to stop the flow. Thereafter the tool 160 can be dropped to operative position by the elevator mechanism 204 via handwheel 222 and caused to traverse the length of traffic surface back and forth for several or even many passes until the operator recognizes the degree of mixing as satisfactory.

The finishing treatments required for different surfaces vary depending upon the coating material being used, the type of surface to which it is being applied, and the desired degree of smoothness or roughness of the finished surface. As previously described these differences may all be accommodated by the height at which the tool 160 is set, from a very light touch to a high pressure sweep with the blades 164 being deflected so that portions of their side faces lie against the coating and provide a pronounced trowelling action. In some cases the mixing and finishing can both be achieved with a single blade setting. If the circumstances do not permit this, however, it will be understood that when the mixing is completed with the tool height appropriate for that function, the operator can cut off the ingredient flow using valves 58, 58' and plugs 158, 158' can then reset the tool 160, via the elevator mechanism 204, to a height suitable for finishing and then treat the coated traffic surface with the tool 160 alone.

As the coating proceeds, the operator may reach locations in the traffic surface where special problems have been previously identified, and at such a point the mix may be altered by adding special ingredients for this particular location by opening one or more additional valves 58, 58' or plugs 158, 158' temporarily to alter the condition of the mix without permanently affecting it, and as soon as the special treatment is complete, the mix can be restored to its original proportions by merely closing the valve or plug which was temporarily opened.

When the traffic surface is a small or odd-shaped area, the machine of the invention has special applicability. The machine can be readily manipulated by the operator into and out of corners, cul-de-sacs and the like. For example, the machine may be propelled up to an edge of the traffic surface and stopped. Then, by reason of the swivelable nature of the wheels 22 and 26, its frame 12 can be turned about the axis of the tool 160, and the next sweep of the tool can occur at any desired angle (e.g. 90 degrees) to the original approach. In addition, the operator can readily guide the tool 160 in sharply curved sweeps by applying the brake 30 to wheel 22 using the actuating lever 36, or the brake 30' to wheel 26 using actuating lever 36', and then swinging the frame 12 about the braked swivel wheel as a center.

From the foregoing description it is apparent that the invention provides an apparatus of phenomenal flexibility because of (1) its ability to handle ingredients which are impractical to mix as a batch, (2) by making it possible to withhold or add ingredients during the treatment process to accommodate changing conditions of the traffic surface being treated, (3) to treat surfaces of limited area and unusual shape, (4) to apply any of various types of surface finishing treatment to a coating in connection with the applying and mixing and without changing tools, and thereby to handle expeditiously a wide variety of coating situations which, heretofore, would have been impossible to deal with except by extremely slow, laborious and expensive manual methods.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. For example, equipment substantially as described may be adapted for use with a motorized vehicle, or may be modified to be itself automotive. In addition it is possible to adapt the principles of the invention to provide mixing and finishing tools of different sizes and to develop applications in which a plurality of simultaneously or alternately operating rotary mixing and finishing tools would be effective. It is intended that the patent shall cover, by suitable expression in the appended claims, whatever features of patentable novelty exist in the invention disclosed.

What is claimed is:

1. A method of applying to a traffic surface a coating composition consisting of plural ingredients, wherein the method comprises the steps of:

(a) depositing a plurality of ingredients from a plurality of individual supply sources upon a traffic surface to be coated, with the deposits of ingredients being made in close proximity to each other to form a deposit mixture;

(b) bringing into contact with the deposit mixture a rotary stirring tool which includes a disk having depending blades that are arranged in an arr about an axis that extends substantially normal to the traffic surface, with the stirring tool having means connecting each of the blades to the disk so that, when the disk and the blades are rotated about said axis, the blades are permitted to move a limited amount relatively toward and away from the disk, and to rock relative to the disk about axes that extend substantially parallel to the traffic surface;

(c) rotating the tool about said axis with the blades being urged into substantially continuous contact with the traffic surface and with the deposited ingredients to effect a rapid mixing of the ingredients to a condition of uniform consistency; and, (d) applying the mixed ingredients to the traffic surface by continuing rotation of the tool about said axis, with the blades moving relative to the disk as is needed to conform their movements to the contour of the traffic surface and to substantially maintain contact with the traffic surface.

2. The method of claim 1 wherein the step of depositing ingredients from individual supply sources includes the step of intermittently starting and stopping the deposit of at least a selected one of the ingredients to accommodate variations in the condition of the traffic surface being coated.

3. The method of claim 1 wherein the step of rotating the tool includes the step of adjusting the speed of tool rotation to accommodate the nature of the ingredients that are being applied to the traffic surface.

4. The method of claim 1 wherein the step of depositing a plurality of ingredients from a plurality of individual supply sources includes the steps of:

(a) progressively applying the deposits of ingredients in a path along the surface; and, (b) moving the rotating stirring tool along said path concurrently with the step of depositing the ingredients and directly subsequent to the deposit thereof.

5. The method of claim 4 wherein the step of depositing a plurality of ingredients from a plurality of individual supply sources includes the step of metering the deposition flow of said ingredients, and wherein the step of moving the rotating stirring tool includes the steps of:

(a) controlling the speed of movement of the tool along said path; and, (b) adjusting both said deposition flow and said speed of movement in relationship to each other to accommodate both the nature of the coating being applied and the nature of the surface being treated.

6. The method of claim 5 further including the step of controlling the speed of rotation of the tool and controlling the speed of tool movement along the path in relationship to each other to accommodate the nature of the coating being applied and the condition of the traffic surface being coated.

7. Apparatus for applying coating compositions consisting of plural ingredients to traffic surfaces, the apparatus comprising:

(a) a frame and wheels for supporting the frame upon a traffic surface to be coated;

(b) plural supply source containers mounted on the frame, with a separate one of the containers being provided one or each of the ingredients of the ultimate composition;

(c) a plurality of dispensing means with a separate one of the dispensing means being provided for each of the supply sources for depositing the corresponding ingredient directly upon the traffic surface, said dispensing means being so clustered as to deposit the ingredients in close proximity to each other; and, (d) applicator means for mixing the ingredients on the traffic surface and applying the resulting coating composition to the traffic surface, the applicator means comprising:

(i) a rotary stirring and smoothing tool having a supporting disk, depending blades substantially radiating from an axis normal to the traffic surface, and mounting means movably connecting the blades to the disk for permitting limited movements of the blades in directions extending toward and away from the traffic surface, and for permitting rocking movements of the blades about axes that extend substantially parallel to the traffic surface;

(ii) a motor on the frame;

(iii) power transmission means connecting said tool and said motor for rotating the tool about said axis; and, (iv) means for supporting the tool in a position below said frame.

8. The apparatus of claim 7 wherein at least selected ones of the wheels are so mounted as to be swivelable with respect to the frame and, the apparatus further includes means for selectively braking at least certain ones of the wheels individually to assist the apparatus in making turns of short radius.

9. The apparatus of claim 7 wherein each of the dispensing means further includes:

(a) means for adjustably metering the dispensing flow of the associated ingredient; and, (b) independent means for stopping or starting the flow of the associated ingredient without affecting the adjustment of the metering means.

10. The apparatus of claim 7 wherein the means for supporting the stirring and smooth tool further includes means for lowering and raising the tool in order to effect one of several different types of contact between the blades and the coated surface to apply a finish surface to the coating that is appropriate to each particular situation.

11. Apparatus for applying coating compositions consisting of plural ingredients to traffic surfaces, comprising:

(a) a frame and wheels for supporting the frame upon a traffic surface to be coated;

(b) plural supply source containers mounted on the frame, one for each of the ingredients of the ultimate composition;

(c) a dispensing means for each of the supply sources for depositing the corresponding ingredient directly upon the traffic surface, said dispensing means being so clustered as to deposit the ingredients in close proximity to each other; and, (d) means for mixing the ingredients on the traffic surface and finishing the surface of the coating, said means comprising:

(i) a stirring and smoothing tool having depending blades substantially radiating from an axis normal to the traffic surface;

(ii) a motor on the frame;

(iii) power transmission means connecting said tool and said motor for rotating the tool about said axis;

(iv) means for supporting the tool in a position below said frame; and, (e) wherein the power transmission means includes a vertical drive shaft and wherein the support wheels include an auxiliary carriage with swivelable wheels and a bearing rotatably receiving said drive shaft, and which further includes a thrust sleeve rotatably driven by said drive shaft, supporting the frame by means of its upper end and resting upon the auxiliary carriage at its lower end; and which further includes means for rotatably driving the stirring and smoothing tool from said sleeve, whereby a frame support is provided which makes possible pivoting of the machine about the rotary axis of the tool to maneuver easily in surface areas of irregular outline.

12. The apparatus of claim 11 wherein there is further provided means for connecting said tool with said thrust sleeve to permit relative vertical sliding movement therebetween, and which further includes means to raise and lower the tool to and maintain it in selected vertical positions.

13. Apparatus for applying coating compositions consisting of plural ingredients to traffic surfaces, the apparatus comprising:

(a) dispensing means for individually dispensing a plurality of ingredients of a coating composition upon the traffic surface; and, (b) rotary tool means connected to and movable in association with the dispensing means for stirring the coating ingredients upon the traffic surface and for applying the resulting coating to the traffic surface, the rotary tool means including:

(i) disk means connected to the dispensing means for rotation about an axis that extends substantially normal to the traffic surface;

(ii) a plurality of blades supported upon and depending from the disk and substantially radiating from the axis;

(iii) mounting means movably connecting the blades to the disk for permitting limited movements of the blades in directions extending toward and away from the traffic surface, and for permitting rocking movements of the blades about axes that extend substantially parallel to the traffic surface;

(iv) power means for rotating the tool; and, (v) means for raising and lowering the tool and setting the same in selected positions to control the nature of blade contact with the surface of the coating.

14. A rotary tool for stirring coating ingredients deposited upon a traffic surface and finishing the surface of the resulting coating, comprising:

(a) a disk mounted for rotation about an axis normal to the traffic surface;

(b) a plurality of blades depending from the disk in position to be substantially radiating from the rotational axis of the disk;

(c) means for so mounting each blade upon the disk as to preserve a fixed angular relationship about a vertical axis through the lengthwise center of the blades;

(d) means for mounting each blade for limited bodily movement to and from the disk including means for urging the blade downwardly away from the disk; and, (e) means for rockably mounting each blade for limited rocking movement end-for-end about an axis substantially parallel to the traffic surface.

15. The rotary tool of claim 14 in which the means for so mounting each blade upon the disk as to preserve a fixed angular relationship about a vertical axis through the lengthwise center of the blade includes means for altering the fixed angular relationship which the blade makes with said vertical axis.

16. The rotary tool of claim 14 which further includes a cylindrical shield, surrounding the disk, mounted thereon and depending from the disk to substantially enclose the blades and closely approach the traffic surface to be coated.

17. The rotary tool of claim 16 which further includes means for adjusting the clearance between the lower edge of the shield and the traffic surface.

18. An apparatus for depositing coating ingredients upon a traffic surface, and for applying deposited ingredients to the traffic surface, comprising:

(a) dispensing means for dispensing coating ingredients onto a traffic surface;

(b) rotary tool means for rotation about an axis that extends substantially normal to the traffic surface for stirring the deposited coating ingredients about on the traffic surface and for applying the deposited ingredients to the traffic surface;

(c) mobile support and drive means for supporting the dispensing means and the rotary tool means, and for rotating the rotary tool means about said axis; and, (d) the rotary tool means including:

(i) disk means connected to the mobile support and drive means for rotation about said axis;

(ii) stirring and applicator means including a plurality of blade-like tools positioned below the disk means at locations spaced about and substantially radiating from said axis; and, (iii) mounting means movably connecting the blade-like tools to the disk means for permitting limited movements of the blade-like tools in directions extending toward and away from the traffic surface, and for permitting rocking movements of the blade-like tools about axes that extend substantially parallel to the traffic surface.

19. The apparatus of claim 18 wherein:

(a) the mobile support and drive means includes a frame and wheels for supporting the frame upon the traffic surface;

(b) at least one of the wheels is positioned below the disk;

(c) at least two others of the wheels are positioned near opposite sides of the frame; and, (d) the mobile support and drive means additionally includes braking means for braking said two others of the wheels individually to assist in guiding movements of the apparatus across the traffic surface.

20. The apparatus of claim 18 wherein:

(a) the dispensing means includes means for dispensing a plurality of flows of separate ingredients onto the traffic surface, with each of the flows being adjustably metered, and means for independently stopping and starting each of these metered flows; and, (b) the braking means includes individual hand-operable controls for individually braking said two others of the wheels.

* * * * *